US005762199A

United States Patent [19]

Aguilera

[11] Patent Number: 5,762,199

[45] Date of Patent: Jun. 9, 1998

[54] DAILY POCKET PILL ORGANIZER

[75] Inventor: Mark A. Aguilera, Chico, Calif.

[73] Assignee: Mark Aguilera, Chico, Calif.

[21] Appl. No.: 778,012

[22] Filed: Dec. 31, 1996

[51] Int. Cl.[6] ..... B65D 83/04

[52] U.S. Cl. ..... 206/533; 206/538; 220/525

[58] Field of Search ..... 206/528, 529, 206/533, 534, 538, 539, 540; 220/523, 525

[56] References Cited

U.S. PATENT DOCUMENTS

| | | | |
|---|---|---|---|
| 3,921,806 | 11/1975 | Wawracz | 206/533 |
| 4,124,143 | 11/1978 | Thomas | 206/538 |
| 4,164,301 | 8/1979 | Thayer | 206/538 |
| 4,203,518 | 5/1980 | Current | 206/533 |
| 4,261,468 | 4/1981 | Krebs | 206/538 |
| 4,399,914 | 8/1983 | Damratowski et al. | 206/538 |
| 4,572,376 | 2/1986 | Wrennall | 206/538 |
| 5,322,166 | 6/1994 | Crowther | 206/538 |

*Primary Examiner*—Paul T. Sewell
*Assistant Examiner*—Luan K. Bui

[57] ABSTRACT

The invention includes embodiments of compartmented containers as daily pocket pill organizers. The containers are cylindrical with removable caps. The caps are designed to be supplied with consideration of a patient's functional ability. The containers are pocket sized and have pill compartments in various multiples accordance with the container use. The material of choice is clear plastic so pills in the compartments can be seen. The caps are single and double structures designed for easy access to the pill compartments. The caps can be unsnapped from the containers for easy washing and sterilizing the cap parts and the containers.

2 Claims, 4 Drawing Sheets

DAILY POCKET PILL ORGANIZER

BACKGROUND OF THE INVENTION

1. Field of the Invention

This invention relates to pill dispensers having multiple compartments. The compartments are useful as day or time reminders for when a patient should take a pill. The present invention is particularly directed towards a compartmented, pocket-size cylindrical dispenser with a removable top. The top has turn and snap-up covers for accessing openings to the compartments. Notations on the compartments can be arranged as reminders to take certain pills daily. The compartments are of sufficient size to hold a multiple of pills.

2. Description of the Prior Art

Many types of pill dispensers are available in the market place. Most of these dispensers square with pull-up tops. Some small round dispensers are also available. A variety of these devices have been patented. No dispensers seen in past art patents and in the market place corresponded directly with the design of the present invention as set forth in the following specification.

SUMMARY OF THE INVENTION

Therefore, in practicing my invention, I provide a small cylindrical compartmented daily pocket pill organizer in embodiments having several types of easy-opening caps. The daily organizer containers of this invention can be structured of clear plastic so the remaining pills in any compartment are easily ascertained. A choice of snap-up and turnaround caps are available so a cap can be supplied in accordance with a patient's ability to open it.

As a principal object, the present invention provides a daily pill organizer in a pocket size compartmented container.

Another object of the invention is to provide a compartmented pill dispenser offering a choice of easy-opening caps.

A further object of my invention is to provide a daily pocket pill organizer in a small compartmented container structured of clear plastic so the amount of pills in any compartment can be seen without opening the cap.

A still further object of the invention is to provide a pocket sized daily pill organizer that is take apart for washing and sterilization.

Other objects and the many advantages of the present invention will become apparent from reading descriptions of numbered parts in the specification and comparing them with like numbered parts shown in the included drawings.

DESCRIPTION OF THE PREFERRED EMBODIMENTS

Figure 1:
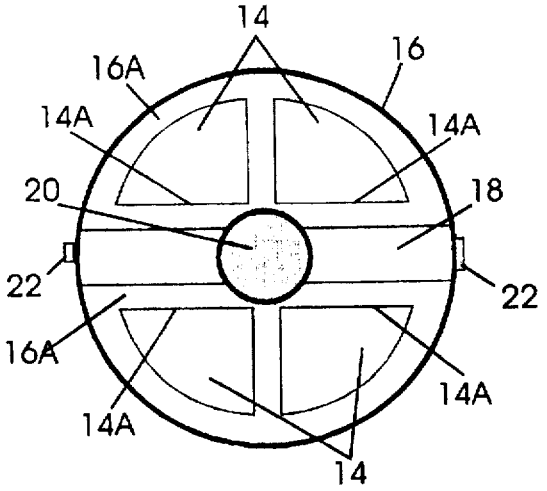
FIG. 1 shows a top plan view of a cap with snap-up openable compartment covers compatible with a first embodiment of a daily pocket pill dispenser in accordance with the invention.
Figure 3:
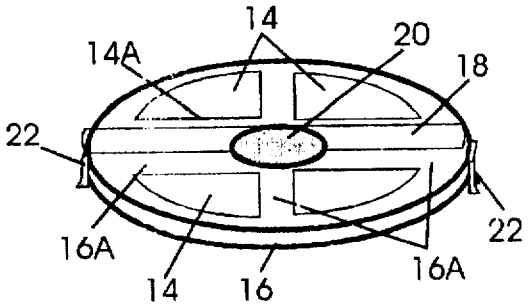
FIG. 3 shows the openable cap of FIG. 1 in a perspective view.
Figure 4:
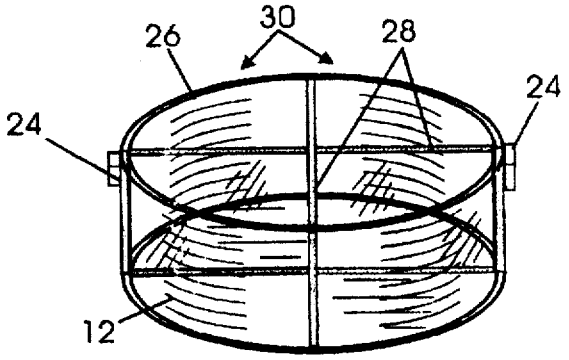
FIG. 4 shows the container and the compartment dividers of the FIG. 2 first embodiment of the invention in a sectioned elevation view.
Figure 2:
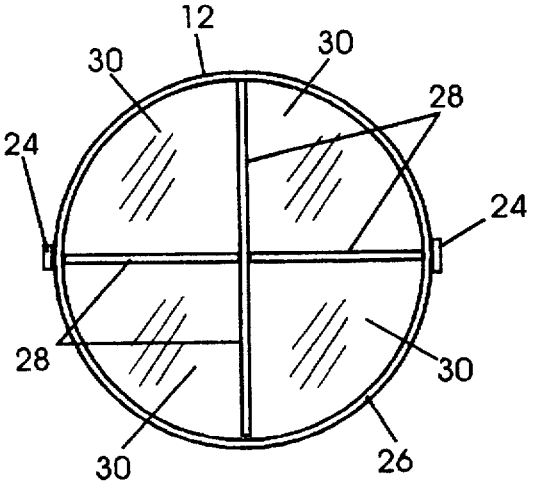
FIG. 2 shows a top plan view of a container according to the present invention in a small four-compartmented first embodiment.
Figure 5:
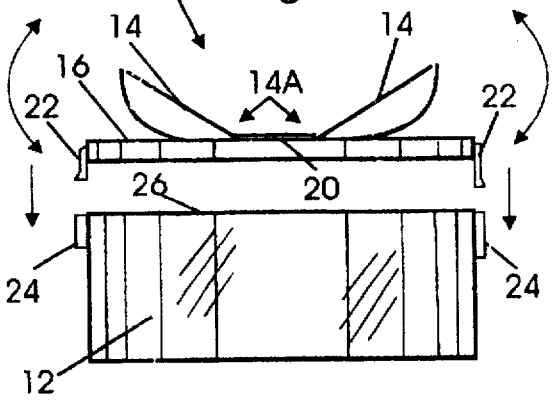
FIG. 5 shows a side elevation view of the invention ready for snap-on installation of the openable cap.

Referring now to the drawings where the embodiments of the invention generally are referenced as invention 10, invention 10A, invention 10B, and invention 10C. Invention 10 is illustrated in FIGS. 1–5. In FIG. 1, openable cap 16 has pull-up sections 14 for compartment access and a round center section 20 supported by collar framework 16A and a center cross support 18. Openable sections 14 are affixed to collar framework 16A along one side by living hinges 14A. Cap 16 has insert snaps 22, one on each side, which are used with snap fitting receivers 24, seen in FIG. 2, for attachment of cap 16 on container rim 26 to container 12. In a top plan view at FIG. 2, container 12 has four dividers 28 that form compartments 30. FIG. 3 is a perspective drawing of cap 16 to show it positioned over container 12 in FIG. 4. FIG. 4 is a perspective view of container 12 and cap 16 in FIG. 4 is positioned above container 12 as it would be ready for installation. To install cap 16, insert snap fittings 22 are pushed down into snap fitting receivers 24 on the sides of container 12. For access to pill compartments 30, openable cap sections 14 affixed along one side by living hinges 14A to collar frame 16A can be pulled up and opened as shown in FIG. 5. FIG. 5 shows invention 10 and cap 16 in side elevation views. Cap 16 is ready for installation by snapping insert snap fittings 22 down into snap fitting receivers 24. Openable sections 14 attached to collar 16 by living hinges 14A are illustrated in the open position. Cap 16 can be removed by pulling up on the edges.

Figure 6:
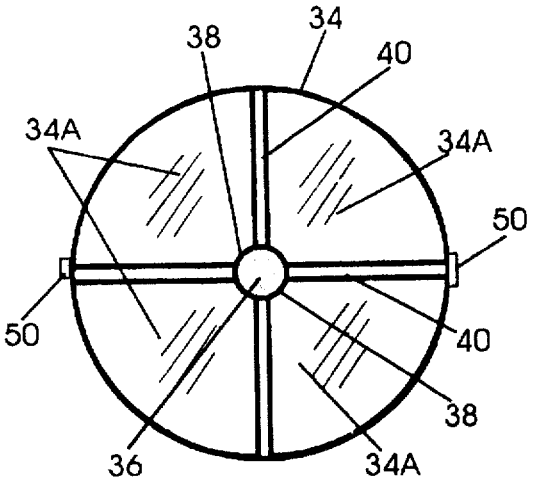
FIG. 6 shows a top plan view of a two-piece cap offered in part with a second embodiment of the invention.
Figure 8:
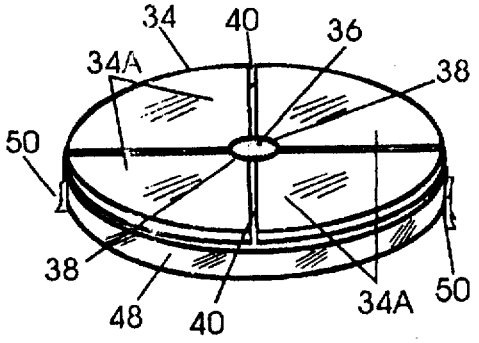
FIG. 8 shows the two-piece cap of FIG. 6 in a perspective view.
Figure 9:
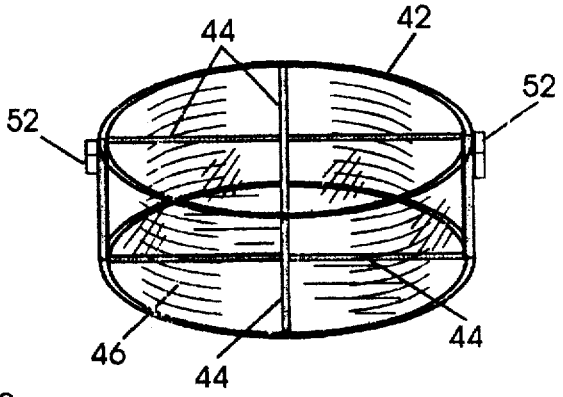
FIG. 9 shows the divided container of FIG. 7 in a perspective view.
Figure 7:
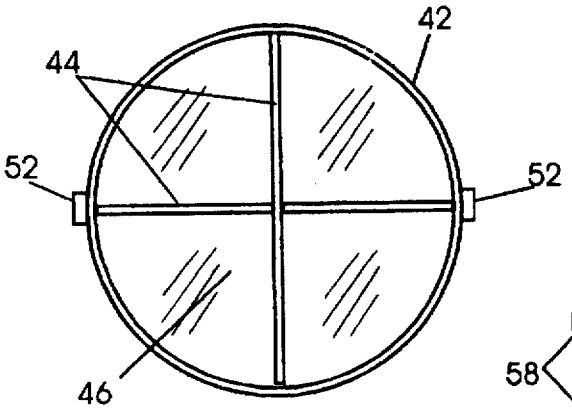
FIG. 7 shows the four-compartmented container arranged for use with the two-piece cap of FIG. 6 in part with a second embodiment of the present invention.
Figure 10:
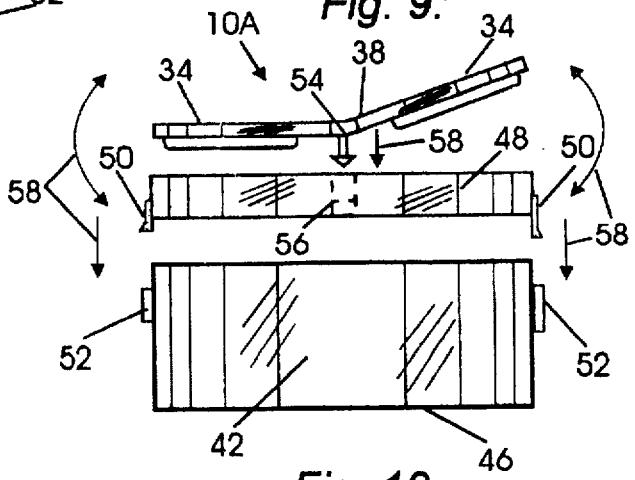
FIG. 10 shows a second embodiment of the invention in a side elevation view of the four-compartmented container with the cap parts ready for assembly above the container.

Embodiment 10A is illustrated in FIGS. 6–10. Container 42 of embodiment 10A as illustrated in FIG. 9 is similar to container 12 in FIG. 4 of embodiment 10 with the principal difference being the openable sections 34A of cap 34. Openable sections 34A are individual pieces and have no framework around them. The containers 12 in FIG. 4 and 42 in FIG. 9 are illustrative only and no container shown in any embodiment of the present invention is restricted to a particular number of compartments. Cap 34 of embodiment 10A is shown at FIG. 6 in a top plan view. Openable cap sections 34A are triangular in shape, widened at inner facing apex ends where they are attached by living hinges 38 to circular center support 36. Cap 34 is two-piece, each piece having a top and a bottom side, with a first cap piece being snap-attached to a spoked second cap piece 48 under it by a snap-in pin 54 that holds the two cap pieces together. See FIG. 10 for details of a spoked cap piece. There is a small opening 40 between each of the openable sections 34A. Openings between the spokes of second cap 48 allows access to pill compartments 46 and the openings 40 between the openable sections 34A are sealed off by the spokes of second cap 48. Second cap 48 is spoked similar to spoked second cap 66 of embodiment 10B in FIG. 12. As can be seen in FIG. 10, openable sections 34A have under protrusions that snap down inside the spoke openings of second cap 48 to seal off compartments 46. Snap inserts 50 are on second cap 48 as can be seen in FIG. 6. Snap insert receivers 52 are shown on each side of container 42 in FIG. 7. To attach cap 34 to container 42, cap 34 is pushed down on the open top of container 42 with snap inserts 50 snapped down into snap insert receivers 52. This holds cap 34 securely attached to container 42 so openable cap sections 34A can be pulled up without pulling cap 34 off of container 42. Cap 34 can be removed from container 42 by grasping the edges of second cap 48 and pulling upward. FIG. 8 shows cap 34 assembled in a perspective view to better illustrate the numbered parts. The attachment of the two cap sections is accomplished by a center snap-in pin 54 seen in FIG. 10. Snap-in pin 54 fits into pin receiver 56. Container 42 is shown in a top plan view in FIG. 7 and in a perspective view in FIG. 9. Vertical patricians 44 form the four compartments 46. FIG. 10 illustrates invention 10A in a side elevation view with openable cap sections 34A and second cap section 48 above container 42. Movement arrows 58 show how openable lids 34A open and how the different sections are moved to assemble the invention 10A embodiment of the daily pocket pill organizer.

Figure 11:
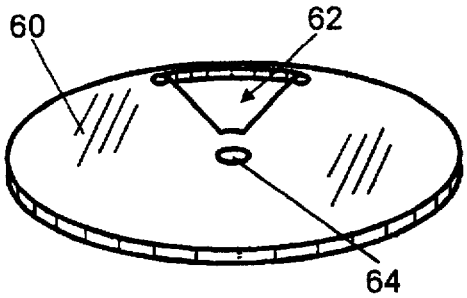
FIG. 11 shows an upper turnaround cap cover with a pill compartment access opening and the position of a center cap snap axle for use with a two-piece cap and a multi-compartmented container of a third embodiment of the invention.
Figure 12:
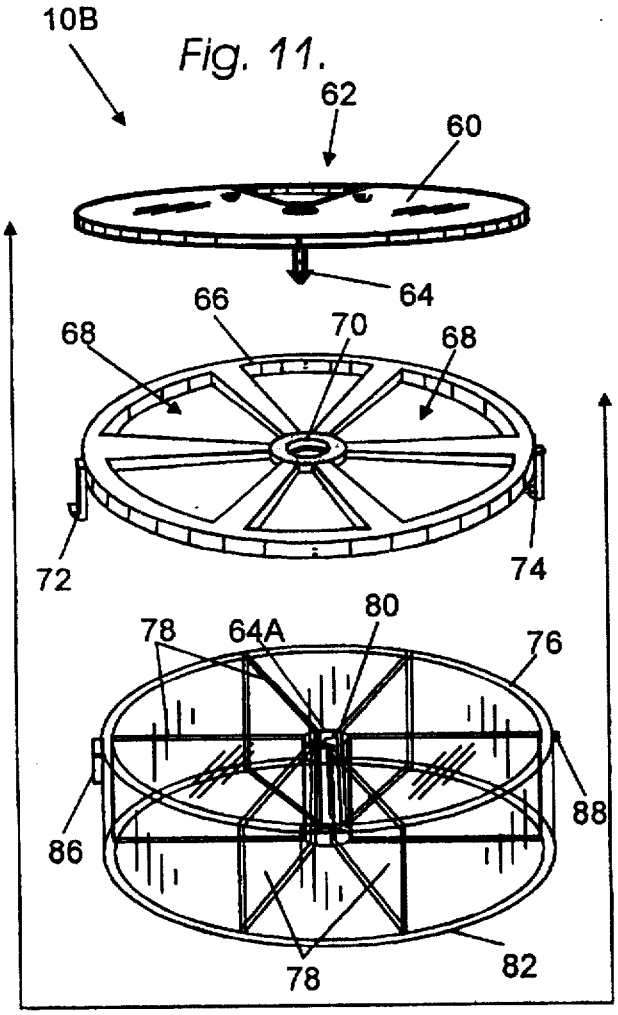
FIG. 12 shows a third embodiment of the invention in a multi-compartmented container with a two-piece cap positioned above it ready for installation.
Figure 13:
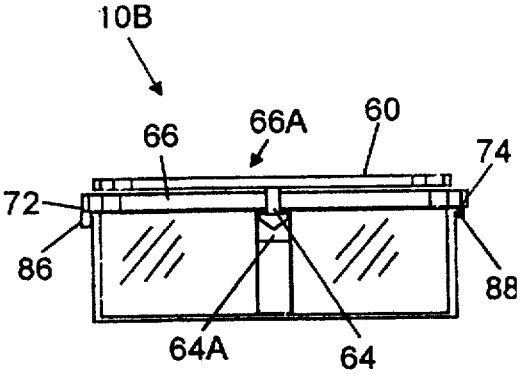
FIG. 13 shows the third container embodiment of FIG. 12 in a side elevation view with the two-piece cap attached. The drawing is sectioned to disclose the cap snap axle attachment and container axle compartment.
Figure 14:
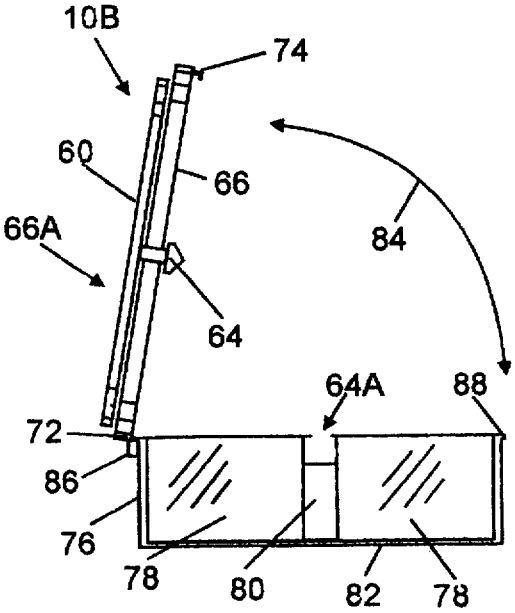
FIG. 14 shows the embodiment of FIG. 13 drawn sectioned with the two-piece cap raised to illustrate a living hinge on one side of the snap-down cap attachments.

Invention 10B is shown as a multi-compartmented version in a third embodiment of the invention in FIGS. 11–14. FIG. 11 shows covering twist cap or covering disc 60 with pill compartment access opening 62 at one side and cap snap axle or attachment pin 64 in the center. Centered cap snap axle 64 is better seen in the exploded view of invention 10B at FIG. 12 where covering twist first cap 60 is positioned over spoked second cap 66 ready for snap-together by inserting cap snap axle 64 into snap axle receiver or apertured center disc 70. FIG. 12 shows the second cap 66 being wheel-like with spokes radiating outwardly from the apertured center disc 70 to a supporting rim which defined a plurality of triangular openings 68 between the spokes. The plurality of triangular openings 68 are providing fixed access to compartments of the compartmented cylindrical container 76. The assembled two-piece cap 66A is then attached to container 76 by inserting side snap 72 into snap-in receiver 86 and snap clip 74 over clip receiver 88. Side snap 72 in snap receiver 88 acts like a living hinge so two-piece cap 66A can be opened up by releasing snap clip 74 from snap receiver 88 as shown in FIG. 14. The assembled side elevation view of invention 10B in FIG. 13 is sectioned to shows how cap snap axle 64 fitting through aperture 70 in spoked second cap 66 holds twist cap 60 and spoked cap 66 together to form a single cap 66A. The widened funnel-like tip end of snap axle 64 fits into receiver compartment 64A in a top section of cylinder 80 where compartment walls 78 converge along container bottom 82. Although not restricted to this, clear plastic would be the material of choice for the manufacture of the various embodiments 10 of the present invention. Clear materials would allow a patient to see the remaining pills in the compartments. FIG. 12 illustrates multi-compartment container 76 in clear plastic form.

Figure 15:
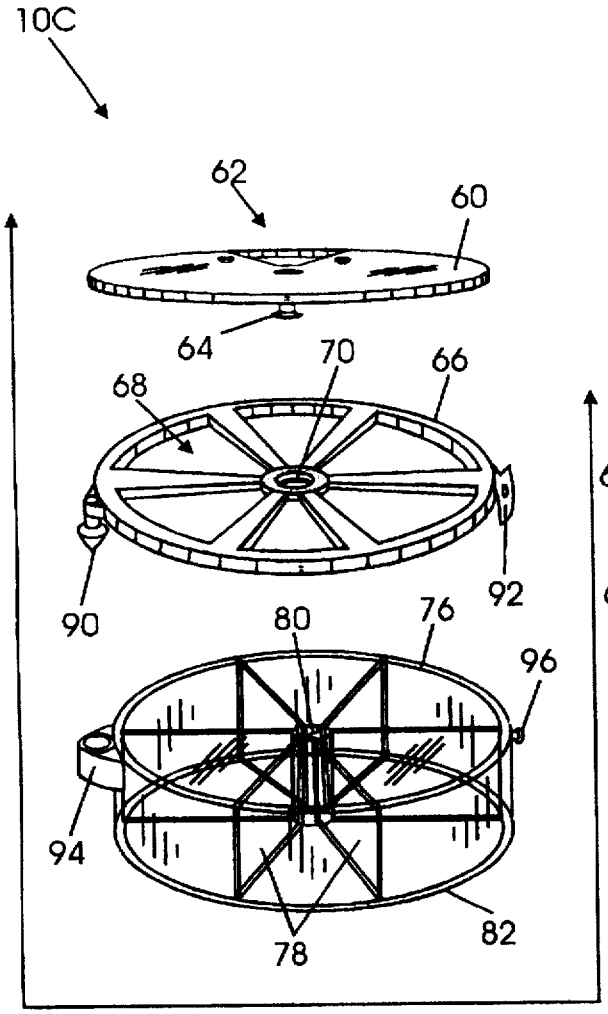
FIG. 15 shows a multi-compartmented container fourth embodiment of the invention with a special snap-in pivotal axle on one side of the two-piece cap and a snap-on fastener on the opposite side. The center snap-in attachment axle holding the two cap sections together has been flattened and the entire cap can be unfastened on the snap side and rotated to open the container.
Figure 16:
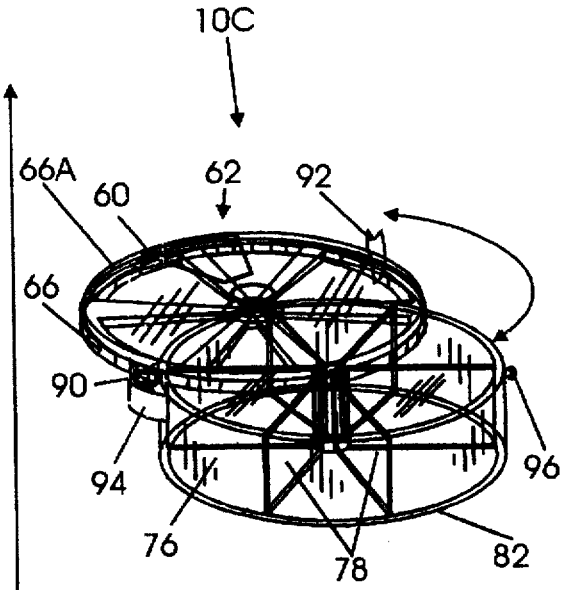
FIG. 16 shows the daily pocket pill organizer of FIG. 15 assembled illustrating the two-piece cap swung open at the pivotal cap edge axle hinge.

FIGS. 15–16 illustrate embodiment 10C which has a special snap-in axle 90 attached to one side of spoked second cap 66. Except for the pivotal cap arrangement, embodiment 10C is the same as embodiment 10B. The same parts numbers are used with the addition of snap-in axle 90, snap-in axle receiver 94, in the side of container 76, snap-on lock fitting 92 on the side wall of spoked second cap 66, and lock receiver stud 96 protruding from the outside wall of container 76. By unsnapping snap-on lock fitting 92 from stud 96, assembled cap 66A can be rotated to open as illustrated in FIG. 16. In embodiment 10C, cap snap axle 64 has been flattened and does not extend enough below aperture 70 to interfere with the assembled cap 66A being rotated to open. For cleaning or sterilizing, assembled caps 60 and 66 as cap 66A can be unsnapped from container 76 by pulling it upward. Snap-in axle receiver 94 will release snap-in axle 90 when snap-on lock fitting 92 has been unfastened from lock receiver stud 96.

By referencing explanations of numbered parts in the foregoing specification with like numbered parts illustrated in the drawings, anyone skilled in the art should understand the structure and use of the invention embodiments described. Embodiments of the present invention are not limited to a particular number of compartments or a particular size. Date and time information may be inscribed on the dispenser surfaces at the discretion of the user.

Although I have described four embodiments of my invention with considerable details in the foregoing specification and illustrated them extensively in the drawings, it is to be understood that I may make changes in the structure of the devices so long as any changes made remain within the scope of the appended claims and any changed devices similar to mine made by others that fall within my claim scope, I shall consider such devices to be my invention.

What is claimed is:

1. A compartmented cylindrical container having a removable snap-on cap, said cap being two-piece with each piece having a top and a bottom side, a first piece being a rotatable covering disc having a small triangular opening therein, there being an attachment pin protruding downward from a central position on said bottom side of said covering disc, said pin being a pivotal hinge attachment of said covering disc to a second cap piece of said two-piece cap under said covering disc, said second cap piece being wheel-like with spokes radiating outwardly from an apertured center disc to a supporting rim there being triangular openings between said spokes, said triangular openings providing fixed access to compartments of said container by said second cap piece being attached by snap fittings on said second cap piece temporarily affixed to snap fitting receivers on said container, said covering disc being rotatable thereby providing access to one of a particular said compartments of said compartmented cylindrical container through one of said triangular openings, said two-piece cap being removable, said two-piece cap being openable at one side by release of one of said snap fitting on one side of said container with an opposite side of said snap fitting being a hinging means.

2. The compartmented cylindrical container of claim 1 wherein said hinging means including said snap fitting being of living hinge structure.

* * * * *